US006067948A

United States Patent [19]

Kreuter

[11] Patent Number: 6,067,948

[45] Date of Patent: May 30, 2000

[54] DEVICE FOR ACTUATING AT LEAST ONE GAS EXCHANGE VALVE OF AN INTERNAL COMBUSTION ENGINE

[75] Inventor: Peter Kreuter, Aachen, Germany

[73] Assignee: META-Motoren-und-Energie-Technik GmbH, Germany

[21] Appl. No.: 09/239,506

[22] Filed: Jan. 28, 1999

[30] Foreign Application Priority Data

Jan. 28, 1998 [DE] Germany ..... 198 03 246

[51] Int. Cl.[7] ..... F01L 1/26; F01L 1/25

[52] U.S. Cl. ..... 123/90.22; 123/90.35; 123/90.5; 123/90.55

[58] Field of Search ..... 123/90.22, 90.23, 123/90.27, 90.33, 90.35, 90.48, 90.49, 90.5, 90.52, 90.55

[56] References Cited

U.S. PATENT DOCUMENTS

| | | | |
|---|---|---|---|
| 5,261,361 | 11/1993 | Speil | 123/90.22 |
| 5,501,187 | 3/1996 | Speil et al. | 123/90.22 |
| 5,503,121 | 4/1996 | Speil et al. | 123/90.22 |
| 5,829,400 | 11/1998 | Speil et al. | 123/90.22 |

FOREIGN PATENT DOCUMENTS

| | | |
|---|---|---|
| 40 23 886 | 1/1992 | Germany . |
| 94 11 680 | 10/1994 | Germany . |

OTHER PUBLICATIONS

Vom Aufbau Der Getriebe; Dr. Rudolf Franke; 1948; pp. 19–43.

*Primary Examiner*—Weilun Lo
*Attorney, Agent, or Firm*—Robert W. Becker & Associates

[57] ABSTRACT

A device for actuating at least one load change valve of an internal combustion engine has at least one load change valve arranged in a cylinder head of an internal combustion engine wherein the load change valve has a valve shaft and a closing spring forcing the valve shaft into a closed position. A camshaft having cams is provided. Its axis of rotation is arranged such that it extends perpendicularly to a travel direction of the valve shaft. A transmission arrangement is positioned so as to be movable parallel to the travel direction of the valve shaft. It has a transverse member positioned between the camshaft and the valve shaft parallel to the camshaft and also has rollers positioned on the transverse member on opposite sides of the valve shaft. Each roller cooperates with one of the cams having identical contours. The cam movement of the cams is transmitted by the rollers onto the transverse member performing a linear movement, and the linear movement of the transverse member is transmitted onto the valve shaft. The transmission arrangement also has slides connected to opposed ends of the transverse member. The slides are moveably guided parallel to the travel direction of the valve shaft in the cylinder head.

7 Claims, 2 Drawing Sheets

DEVICE FOR ACTUATING AT LEAST ONE GAS EXCHANGE VALVE OF AN INTERNAL COMBUSTION ENGINE

BACKGROUND OF THE INVENTION

The invention relates to a device for actuating at least one load change valve of an internal combustion engine wherein a load change valve with a valve shaft is positioned in a cylinder head and is forced by a closing spring into the closed position, wherein a camshaft having an axis of rotation extends substantially perpendicularly to the travel direction of the valve shaft and wherein a transmission arrangement is provided which is guided parallel to the travel direction of the load changing valve and transmits the movement of the cam of the camshaft onto the valve shaft of the load changing valve.

For driving the load change valve of an internal combustion engine different systems are being used. In the so-called cup tappet drive the camshaft acts directly onto a cup that is linearly guided above the valve shaft within the cylinder head and transmits the cam movement onto the valve. Such a cup tappet drive is of a relatively compact design in a direction transverse to the camshaft but because of the frictional engagement between cam and end face of the cup tappet is greatly friction loaded. Furthermore, the cup tappet must be embodied with relatively large diameter because of the frictional movement of the cam across its end face so that possibilities in regard to weight reduction are limited.

In another type of valve actuation between the cam shaft and the valve a follower lever, pivot lever, or rocker arm is provided which is actuated by the camshaft and actuates the valve. For engagement between the camshaft and the lever, a roller may be positioned on the lever which substantially reduces friction. A particular feature of the latter drive is that the latter requires additional components which must be themselves supported and thus require more constructive space.

It is therefore an object of the present invention to provide a device for actuating at least one load change valve of an internal combustion engine which combines a simple design with minimal frictional loss.

SUMMARY OF THE INVENTION

The inventive problem is solved in that at the ends of the transverse member of the transmission arrangement slides are provided which are guided moveably and parallel to the travel direction of the valve shaft of the load changing valve in the cylinder head.

With the inventively provided transverse member which is essentially a rigid linearly guided component, the advantages of the conventional cup tappet drive such as a simple design and an especially compact construction viewed in the transverse direction to the camshaft can be maintained. With the aid of the rotatably supported rollers on the transverse member, the frictional losses of conventional cup tappet drives are considerably reduced.

The invention is especially suitable for internal combustion engines which have for each cylinder a plurality of intake valves and/or exhaust valves. The basic design of a valve drive for a combustion engine, with, for example, two intake valves per cylinder, is also disclosed.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of specific embodiments utilizing FIGS. 1 and 2.

Figure 1:
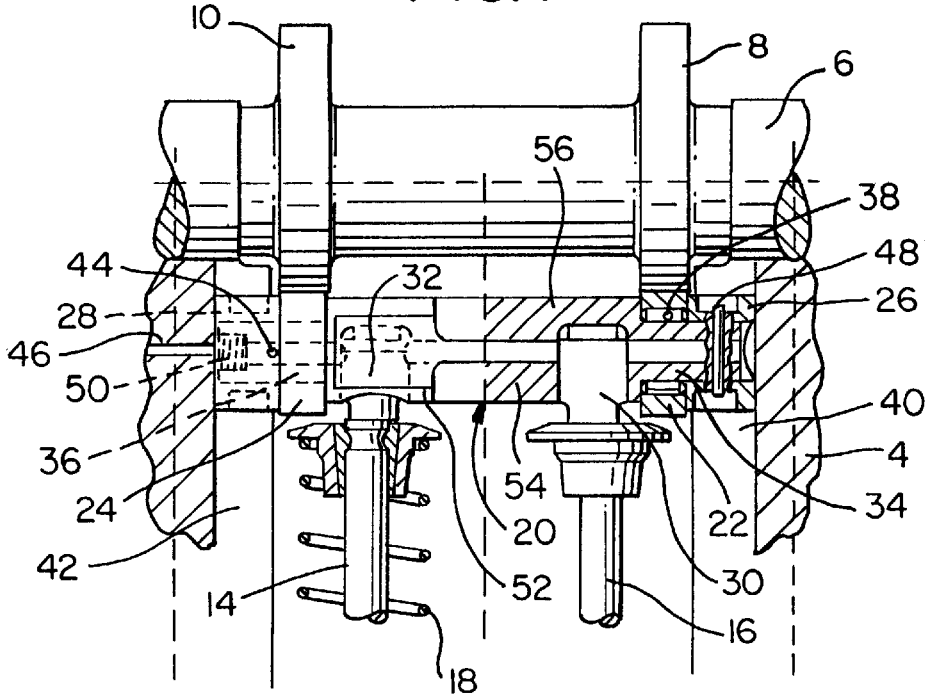
FIG. 1 shows a longitudinal section of the inventive device.
Figure 2:
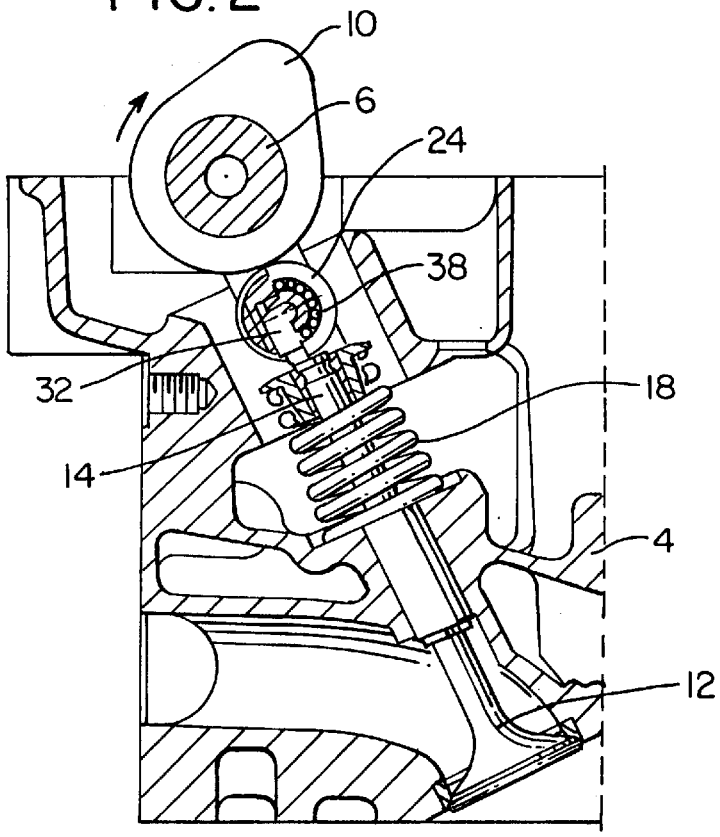
FIG. 2 shows a cross-section of the device according to FIG. 1.
Figure 3:
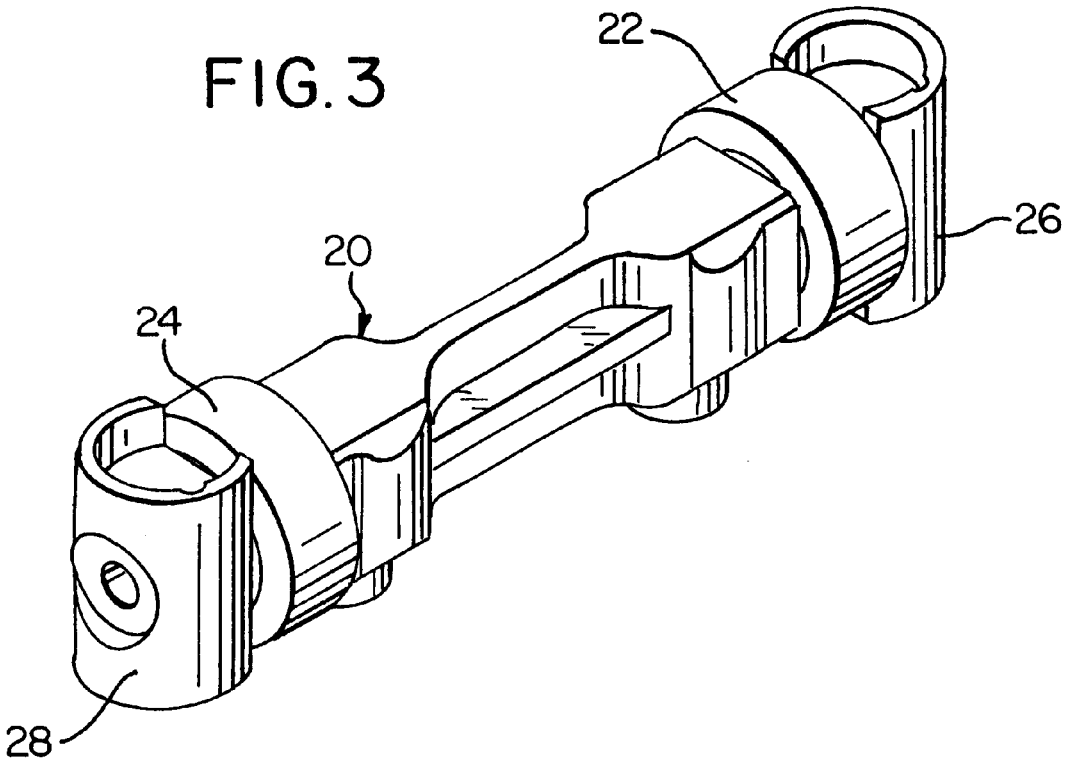
FIG. 3 shows a perspective view from above onto the transverse member with rollers and slides.
Figure 4:
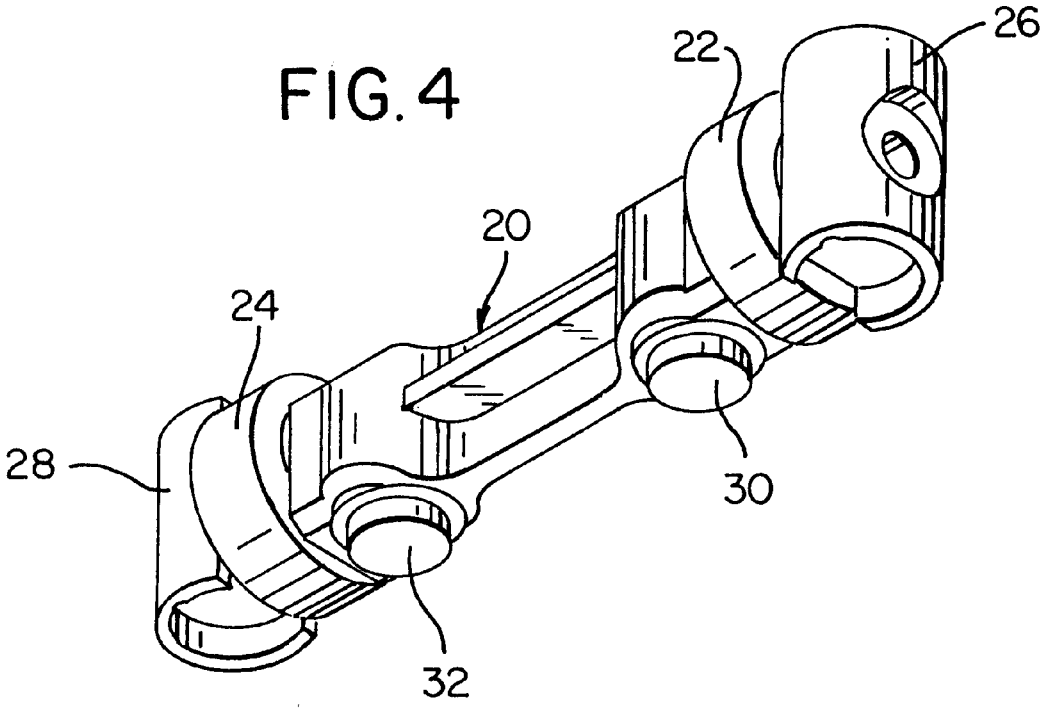
FIG. 4 shows a perspective view from below onto the transverse member with rollers and slides.

According to FIGS. 1 and 2 a camshaft 6 is supported in a manner known to a person skilled in the art at a cylinder head 4. Only two identical cams 8 and 10 of the camshaft 6 are represented. The internal combustion engine has for each combustion chamber two intake valves whereby one intake valve 12 is shown in FIG. 2 and the valve shafts 14 and 16 are shown in FIG. 1. Closing springs force the intake valve into a closed position whereby in the Figures only one closing spring, the closing spring 18, is represented.

For transmitting movement of the cams 8 and 10 of the camshaft 6 onto the valve shaft 14 and 16, a linearly guided transmission arrangement is provided in the cylinder head 4 which is moved in the travel direction of the valve shaft 14 and 16. The transmission arrangement comprises a transverse member 20 on which rollers 22 and 24 are rotatably supported and which receives at its ends slides 26 and 28 which are linearly guided in the cylinder head 4.

Substantially above the valve shafts 14 and 16 the transverse member 20 comprises two blind bores which receive known valve play compensation elements 30 and 32 supported between the base surfaces of the blind bores and the valve shafts 14 and 16.

The transverse member 20 is a bending-resistant (rigid) component ending at both ends in cylindrical ends 34 and 36 which receive rollers 22 and 24 supported thereat by needle bearings 38. The ends 34 and 36 are received without radial play in lateral openings of the slides 26 and 28. The slides 26 and 28 are embodied as dome-shaped members with circular cylindrical or, preferably, part cylindrical cross-section and which are guided without play in corresponding bores 40 and 42 of the cylinder head 4. In order to save space, the cross-sections of the slides 26 and 28 are advantageously designed such that they are part-circular having an angle of greater than 180°, and the bores, in which the transverse member 20 is received, extend from the flat side of the slide.

The transverse member 20 has an axial through bore 44 which reduces weight and which is provided with oil via an oil supply channel 46 in the cylinder head 4 through the slide 28 for supplying the valve compensation elements 30 and 32 with oil and for lubricating the slides 26 and 28. If necessary, the bearings of the rollers 22 and 24 can also be supplied with oil by the throughbore 44.

The transverse member 20 is secured within the slide 26 by a pin 48.

The bore in the left slide 28 shown in FIG. 1 in which the transverse member 20 is received is embodied as a blind bore whereby the bottom wall has an opening for allowing introduction of oil. Between the slide 28 and transverse member 20 a coil spring 50 is provided that is supported in the blind bore of the transverse member and compensates axial tolerances.

For increasing the bending stiffness of the transverse member 20, the transverse member 20 is provided with reinforcement stays 54 and 56 between thick portions 52 in which the valve compensation elements 30 and 32 are received. These stays 54, 56 provide a high bending stiffness about an axis extending perpendicular to the plane of FIG. 1. Preferably, the transverse member 20 is embodied such that its cross-section between the thick portions 52 is substantially cross-shaped. However, other cross-sections are also possible, for example, a T-shaped or a U-shaped cross-section.

The function of the disclosed device is as follows.

The valve compensation elements 30 and 32 ensure that the end faces of the valve shafts 14 and 16 are at all times contacting the valve play compensation elements 30 and 32 and that the valve play compensation elements, in turn, rest with their end faces at the transverse member 20 so that the rollers 22 and 24 are securely held and contacted at the cams 8 and 10. When the camshaft rotates, the rollers 22 and 24 are accordingly radially moved as a function of the contour of the cams 8 and 10 and are thus moved radially away from the axis of the camshaft 6 whereby this radial movement is transformed into a linear movement of the transverse member 20 because of the guiding of the slides 26 and 28 in the cylinder head 4. The linear movement of the transverse member 20 actuates the valves.

The essentially symmetrical arrangement provides that the transverse member 20 is free of any tilting movements about an axis which extends perpendicularly to the paper plane of FIG. 1 at the center between the valve shafts 14 and 16.

In the Figures, the relative arrangement of the individual components is such that the axis of the camshaft 6 and the centerline of the transverse member 20 are positioned in a plane defined by the center lines of the valve shafts 14 and 16 (FIG. 2), whereby the surface areas in which the valve play compensation elements 30 and 32 rest at the valve shafts 16 and 14 are offset relative to the center lines of the valve shafts. This displacement of offset is not required. However, it results in space saving advantages and a rotation of the valve play compensation elements during operation, which is desirable. In order to provide for the slides 26 and 28 in the cylinder head 4 to be substantially free of lateral forces, the camshaft 6 and/or rollers 22 and 24 and/or the longitudinal center line of the transverse member 20 can be offset slightly out of the plane of the valve shafts 14 and 16 so that lateral forces action of the frictional engagement of the rollers 22 and 24 is compensated. The axis of the camshaft 6 is advantageously parallel to the centerline of the transverse members 20 so that they can be moved without tilting according to FIG. 1 upwardly and downwardly.

It is understood that the disclosed embodiment can be altered in many different ways.

For internal combustion engines with only one intake valve the entire arrangement according to FIG. 1 can be shortened by eliminating one of the thick portions with the corresponding valve play compensation element. The embodiment according to FIG. 1 can be expanded such that between the two valves a further roller with cam is provided. The entire arrangement can also be altered and applied for the actuation of three or more valves.

By individually controlling the valve play compensation elements 30 and 32 with oil pressure and with a corresponding embodiment as hydraulically stiff or lockable tappets, the cam contours of individual valves actuated by a common transverse member can be adjusted or individual valves can be switched off. The valves actuated by a common transverse member must not be identical. They can have, for example, different diameters.

The fixed connection between the transverse member 20 and at least one of the slides 26 and 28 must not be embodied with a pin connection 48. It can also be realized with a corresponding embodiment of the cross section of the end of the transverse member 20 engaging the slide.

One of the slides 26 and 28 can be embodied as a unitary part of the transverse member by flattening it on both sides and by fixedly connecting it after application of the rollers. The rollers, which in the shown embodiment are substantially play free between a collar of the transverse member 20 and one of the slides 26 and 28, are embodied in a manner known to a person skilled in the art so that no friction between them and the corresponding collar or the corresponding slide will occur. The invention is useful for intake valves as well as exhaust valves of internal combustion engines.

The specification incorporates by reference the disclosure of German priority document 198 03 246.3 of 28 Jan. 1998.

The present invention is, of course, in no way restricted to the specific disclosure of the specification and drawings, but also encompasses any modifications within the scope of the appended claims.

What is claimed is:

1. A device for actuating at least one gas exchange valve of an internal combustion engine, said device comprising:

at least one gas exchange valve (12) arranged in a cylinder head (4) of an Internal combustion engine, said at least one valve (12) comprising a valve shaft (14, 16) and a closing spring (18) forcing said valve (12) into a closed position;

a camshaft (6) having cams and an axis of rotation arranged such that said axis of rotation extends perpendicularly to a travel direction of said valve shaft (14, 16);

a transmission arrangement positioned so as to be moveable parallel to said travel direction;

said transmission arrangement comprising a transverse member (20) positioned between said cam shaft (6) and said valve shaft (14; 16) parallel to said cam shaft (6);

said transmission arrangement further comprising rollers (22, 24) positioned on said transverse member on opposite sides of said valve shaft (14; 16);

each one of said rollers (22, 24) cooperating with one of said cams (8, 10), wherein said cams (8, 10) have identical contours, wherein a cam movement of said cams is transmitted by said rollers (22, 24) onto said transverse member (20) performing a linear movement and wherein said linear movement of said transverse member (20) is transmitted onto said valve shaft (14; 16);

said transmission arrangement further comprising a first slide (26) and a second slide (28) connected to opposed ends (34, 36) of said transverse member (20);

said first and second slides (26, 28) configured to exclusively guide said transmission arrangement parallel to said travel direction of said valve shaft (14; 16) in the cylinder head (4), wherein the cylinder head (4) has a first bore (40) matching a shape of said first slide (26) and a second bore (42) matching a shape of said second slide (28), wherein said first and second slides (26, 28) are slidably, received in said first and second bores (40, 42), wherein said first and second slides (26, 28) are dome-shaped and have a part-circular cross-section.

2. A device according to claim 1, wherein one of said ends (36) of said transverse member (20) is axially slidable in said second slide (28), said transmission arrangement further comprising a pressure spring (50) arranged between said one end (36) and said second slide (28).

3. A device according to claim 2, wherein the other one of said ends (34) is a unitary part of said first slide (26).

4. A device according to claim 1, wherein said transverse member (20) has a hydraulic valve play compensation element (30, 32) for transmitting movement of said transverse member (20) onto said valve shaft (14; 16) and wherein hydraulic oil is supplied through said transverse member (20) and at least one of said first and second slides (26, 28) to said valve play compensation element (30, 32).

5. A device according to claim 1, wherein said transverse member (20) bridges two neighboring ones of said valve shafts (14; 16), wherein said two rollers (22, 24) are positioned at sides of said two valves shafts (14; 16) facing away from one another, said two rollers (22, 24) arranged relative to contact locations of said valve shafts (14; 16) at said transverse member (20) such that said transverse member (20) is substantially free of tilting moments about an axis extending perpendicularly to a longitudinal extension of said transverse member (20).

6. A device according to claim 5, wherein said ends (34, 36) are positioned outwardly of contact locations of said valve shafts (14, 16) at said transverse member (20) and wherein said rollers (22, 24) are slipped onto said ends (34, 36).

7. A device according to claim 4, wherein a contact location of said valve play compensation element (30, 32) and said valve shaft (14; 16) is offset relative to a center line of said valve shaft (14, 16).

* * * * *

UNITED STATES PATENT AND TRADEMARK OFFICE

CERTIFICATE OF CORRECTION

PATENT NO : 6,067,948

DATED : May 30, 2000

INVENTOR(S) : Peter Kreuter

It is certified that error appears in the above-identified patent and that said Letters Patent are hereby corrected as shown be'ow:

On the title page, item [54] should read as follows:

DEVICE FOR ACTUATING AT LEAST ONE LOAD CHANGE VALVE OF AN INTERNAL COMBUSTION ENGINE

Signed and Sealed this

Twenty-second Day of May, 2001

*Attest:*

Nicholas P. Godici

NICHOLAS P. GODICI

*Attesting Officer*

*Acting Director of the United States Patent and Trademark Office*